US012532964B2

(12) United States Patent
Li et al.

(10) Patent No.: US 12,532,964 B2
(45) Date of Patent: Jan. 27, 2026

(54) FOOTREST EXTENSION MECHANISM AND SEAT EXTENDING AND RETRACTING DEVICE

(71) Applicant: Remacro Technology Co., Ltd., Jiangsu (CN)

(72) Inventors: Xiaohong Li, Jiangsu (CN); Yuankun Li, Jiangsu (CN); Zhanzheng Lv, Jiangsu (CN); Chen Chen, Jiangsu (CN)

(73) Assignee: Remacro Technology Co., Ltd., Suzhou (CN)

( * ) Notice: Subject to any disclaimer, the term of this patent is extended or adjusted under 35 U.S.C. 154(b) by 196 days.

(21) Appl. No.: 18/423,351

(22) Filed: Jan. 26, 2024

(65) Prior Publication Data

US 2024/0156262 A1 May 16, 2024

Related U.S. Application Data

(63) Continuation of application No. PCT/CN2022/109700, filed on Aug. 2, 2022.

(30) Foreign Application Priority Data

Aug. 3, 2021 (CN) ..... 202110887471.9
Aug. 3, 2021 (CN) ..... 202121793688.5

(51) Int. Cl.
*A47C 1/034* (2006.01)
*A47C 1/0355* (2013.01)

(52) U.S. Cl.
CPC ..... *A47C 1/0345* (2013.01); *A47C 1/0355* (2013.01)

(58) Field of Classification Search
CPC ..... A47C 1/0345; A47C 1/0355
See application file for complete search history.

(56) References Cited

U.S. PATENT DOCUMENTS 5,374,100 A * 12/1994 Rogers ..... A47C 7/402 297/391
5,374,101 A * 12/1994 Wiecek ..... A47C 1/0355 297/75

(Continued)

FOREIGN PATENT DOCUMENTS

CN 113892772 A 1/2022
CN 113907551 A 1/2022
CN 217161486 U 8/2022

OTHER PUBLICATIONS

International search report of PCT Patent Application No. PCT/CN2022/109700 issued on Oct. 20, 2022.

*Primary Examiner* — Milton Nelson, Jr.

(57) ABSTRACT

A footrest extension mechanism, including a first link, a second link, a third link, a fourth link, a first footrest member, a driven rod, a second footrest member, and a footrest connecting member; an end of the second link is hinged to the first footrest member, and an opposite end of the second link is hinged to the first link, in which the first link is used to be hinged to a linkage support of a seat; and an end of the fourth link is hinged to the second footrest member, an opposite end of the fourth link is hinged to the third link, an end of the driven rod is hinged to the first footrest member, and an opposite end of the driven rod is hinged to a middle of the fourth link. The adjustment flexibility and the extending length of the footrest extension mechanism are increased.

18 Claims, 5 Drawing Sheets

(56) References Cited

U.S. PATENT DOCUMENTS

| | | | | |
|---|---|---|---|---|
| 5,800,010 | A * | 9/1998 | May | A47C 1/0355<br>297/85 L |
| 7,762,625 | B2 * | 7/2010 | Hoffman | A47C 1/034<br>297/423.26 |
| 8,752,890 | B2 * | 6/2014 | Murphy | A47C 1/037<br>297/423.35 |
| 10,420,422 | B2 * | 9/2019 | Lawson | A47C 1/0355 |
| 10,512,333 | B2 * | 12/2019 | Lawson | A63J 3/00 |

* cited by examiner

FOOTREST EXTENSION MECHANISM AND SEAT EXTENDING AND RETRACTING DEVICE

CROSS-REFERENCE TO RELATED APPLICATIONS

The present disclosure is a Continuation Application of PCT Application No. PCT/CN2022/109700 filed on Aug. 2, 2022, which claims priority of Chinese Patent Application No. 202110887471.9 filed on Aug. 3, 2021 before CNIPA, and Chinese Patent Application No. 202121793688.5 filed on Aug. 3, 2021 before CNIPA. All the above are hereby incorporated by reference in their entirety as part of the present disclosure.

FIELD

The present disclosure relates to the technical field of sofa supports and, particularly, to a footrest extension mechanism and a seat extending and retracting device.

BACKGROUND

With the improvement of people's living standards, functional sofas and seats are becoming increasingly common in life. With the widespread use of functional sofas, the demand for comfort of the sofa seat becomes increasingly high. A mechanical stretching device is generally mounted on the functional seats, so that the seat may be adjusted to a sitting position, a relaxing position or a lying position.

The existing seat apparatus has the following deficiencies: When the seat extends, a footrest mechanism is prone to rubbing against the floor, affecting the user's utilization. The footrest mechanism of the seat may only rotate simply, with a short overall extending length, and may not provide full support for the legs and feet in a relaxing position or a lying position, thus affecting the comfort of the seat.

A conventional slide groove structure is used in an existing mechanical stretching device with an extending footrest plate. The slide groove structure is prone to noise during use, and the slide groove is prone to wear and tear after repeated use, resulting in the leg structure not being able to be opened or retracted smoothly, and the structural stability thereof is poor.

SUMMARY

In order to solve the problems mentioned above, provided in the present disclosure is a footrest extension mechanism, including a first link, a second link, a third link, a fourth link, a first footrest member, a driven rod, a second footrest member, and a footrest connecting member.

An end of the second link is hinged to the first footrest member, and an opposite end of the second link is hinged to the first link, in which the first link is used to be hinged to a linkage support of a seat; an end of the fourth link is hinged to the second footrest member, an opposite end of the fourth link is hinged to the third link, an end of the driven rod is hinged to the first footrest member, and an opposite end of the driven rod is hinged to a middle of the fourth link.

The footrest connecting member includes a first connecting member and a second connecting member, in which an end of the first connecting member is hinged to a middle portion of the second footrest member, an opposite end of the first connecting member is hinged to an end of the second connecting member, an opposite end of the second connecting member is hinged to a middle of the second link, and the middle of the second connecting member is hinged to a middle of the fourth link.

Further, a middle of the second footrest member is provided with a first restricting member, and the second footrest member is retracted to a limit position to prevent the second footrest member from loosening when the first restricting member is fitted against the second connecting member.

Further, an end of the second link proximal to the first link is provided with a first connecting point, the second link is hinged to a middle of the third link at the first connecting point, and the third link is used to connect with the linkage support.

Further, an end of the second link proximal to the first footrest member is provided with a second connecting point, and the second link is hinged to the second connecting member at the second connecting point.

Further, an end of the fourth link proximal to the second footrest member is provided with a footrest connecting point, a driven-rod connecting point, and a connecting-member connecting point in sequence.

The fourth link is connected to the second footrest member at the footrest connecting point, the fourth link is connected to the driven rod at the driven-rod connecting point, and the fourth link is connected to the second connecting member at the connecting-member connecting point, in which the driven-rod connecting point is provided between the footrest connecting point and the connecting-member connecting point.

Further, the first footrest member is provided with a second-link connecting point and a linkage point, and a distance between the linkage point and the driven-rod connecting point is greater than a distance between the linkage point and the second-link connecting point.

Further, the first footrest member is positioned above the second footrest member when the footrest extension mechanism is retracted to a limit position, and footrest surfaces of both the first footrest member and the second footrest member are in a same vertical plane.

Further, footrest surfaces of both the first footrest member and the second footrest member are rotated upwards when the footrest extension mechanism is extended from a retracted position to a limit position, and the first footrest member and the second footrest member are spaced apart from each other.

Further, the footrest extension mechanism also includes a footrest plate assembly, the footrest plate assembly including a first footrest plate and a second footrest plate, in which the first footrest plate is connected to the first footrest member, and the second footrest plate is connected to the second footrest member.

The present disclosure is also provided with a seat extending and retracting device, including a footrest extension mechanism, a linkage mechanism, and a back mechanism, in which an end of the linkage support is connected to the back mechanism, an opposite end of the linkage support is connected to the footrest extension mechanism, and the footrest extension mechanism is connected to the footrest plate assembly.

BRIEF DESCRIPTION OF THE DRAWINGS

In order to illustrate the technical solutions of the present disclosure more clearly, the following drawings are briefly described as required in the context of the embodiments or the prior art. Obviously, the following drawings illustrate only some of the embodiments of the present disclosure.

Other relevant drawings may be obtained on the basis of these drawings without any creative effort by those skilled in the art.

Figure 1:
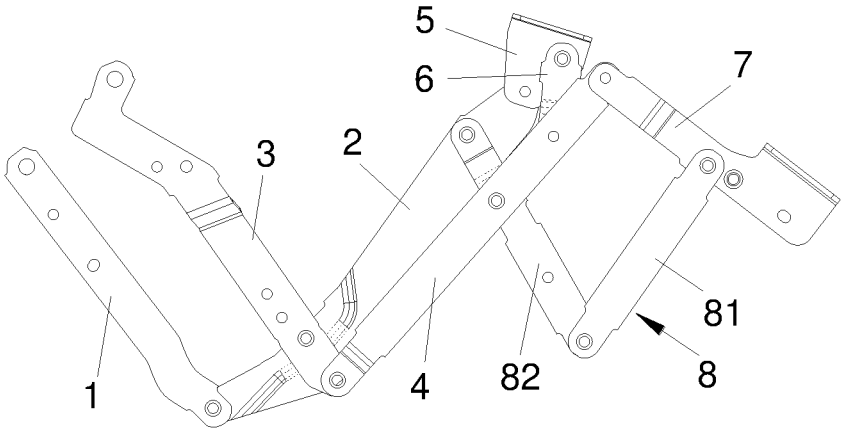
FIG. 1 is a structural diagram of a footrest extension mechanism of the embodiment of the present disclosure.

The meanings of the attached markings are as follows: 1 first link; 2 second link; 21 first connecting point; 22 second connecting point; 3 third link; 4 fourth link; 41 footrest connecting point; 42 driven-rod connecting point; 43 connecting-member connecting point; 5 first footrest member; 51 second-link connecting point; 52 linkage point; 6 driven rod; 7 second footrest member; 71 first restricting member; 8 footrest connecting member; 81 first connecting member; 82 second connecting member; 9 footrest plate assembly; 91 first footrest plate; 92 second footrest plate; 10 linkage support; 11 back mechanism; 12 support structure; 121 base; 122 first supporting member; 123 second supporting member; 124 base driven assembly; 125 seat driven member; 126 back driven member; 13 linkage structure; 131 lateral plate; 132 first linkage member; 133 second linkage member; 134 third linkage member; 14 transmission structure; 141 first transmission member; 142 second transmission member.

DETAILED DESCRIPTION OF THE EMBODIMENTS

The technical solutions in the embodiments of the present disclosure are clearly and completely described and discussed below in conjunction with the attached drawings of the embodiments of the present disclosure. Obviously, the embodiments described herein are only some of the embodiments of the present disclosure but not all of them. Based on the embodiments in the present disclosure, all other embodiments obtained by those skilled in the art without creative efforts fall within the scope of protection of the present disclosure.

Reference herein to "an embodiment" or "embodiments" means that a particular feature, structure, or characteristic may be included in at least one implementation of the present disclosure. In the description of the present disclosure, it is to be noted that the terms "up", "down", "left", "right", "top", "bottom", and other orientation or position relationships are based on the orientation or position relationships shown in the attached drawings. It is only intended to facilitate description of the present disclosure and simplify description, but not to indicate or imply that the referred device or element has a specific orientation, or is constructed and operated in a specific orientation. Therefore, they should not be construed as a limitation of the present disclosure. Furthermore, the related terms "first" and "second" are used for descriptive purposes only and are not to be understood as indicating or implying relative importance or implicitly indicating the number of indicated technical features. Thus, the features defined by "first" and "second" may explicitly or implicitly include one or more of the features. And the terms "first", "second", "third", and the like are used to identify different objects and are not intended to describe a particular sequence or order. It should be understood that the data herein used may be interchangeable in appropriate cases so that the embodiments of the present disclosure described herein may be implemented in an order other than what is illustrated or described herein.

EMBODIMENT

In view of the problems mentioned above in the prior art, an objective of the present disclosure is to provide a footrest extension mechanism and a seat extending and retracting device. By adjusting the structure of the footrest extension mechanism of the seat, an extending length of a footrest plate of the seat is increased, the support for a user's legs and feet is improved, and the comfort of the seat is improved.

The present embodiment is provided with a footrest extension mechanism as shown in FIG. 1, including a first link 1, a second link 2, a third link 3, a fourth link 4, a first footrest member 5, a driven rod 6, a second footrest member 7, and a footrest connecting member 8.

An end of the second link 2 is hinged to the first footrest member 5, and an opposite end of the second link 2 is hinged to the first link 1, in which the first link 1 is used to be hinged to a linkage support 10 of a seat; an end of the fourth link 4 is hinged to the second footrest member 7, an opposite end of the fourth link 4 is hinged to the third link 3, an end of the driven rod 6 is hinged to the first footrest member 5, and an opposite end of the driven rod 6 is hinged to a middle of the fourth link 4; and the footrest connecting member 8 includes a first connecting member 81 and a second connecting member 82, in which an end of the first connecting member 81 is hinged to a middle of the second footrest member 7, an opposite end of the first connecting member 81 is hinged to an end of the second connecting member 82, an opposite end of the second connecting member 82 is hinged to a middle of the second link 2, and the middle of the second connecting member 82 is hinged to a middle of the fourth link 4.

In the present embodiment, the first footrest member 5 is hinged to the fourth link 4 by means of the driven rod 6, and the fourth link 4 is connected to the second footrest member 7. There is no connection relationship between the first footrest member 5 and the fourth link 4, increasing the movement flexibility of the first footrest member 5 and the second footrest member 7 during retraction and extension. The first footrest member 5, the driven rod 6, the fourth link 4, the second connecting member 82, and the second link 2 constitute a five-link mechanism. The first footrest member 5 and the second footrest member 7 may be brought together and separated more flexibly, a distance between the first footrest member 5 and the second footrest member 7 is increased after separation, and an extending length of the second footrest member 7 is increased.

Specifically, a middle of the second footrest member 7 is provided with a first restricting member 71, and the second footrest member 7 is retracted to a limit position when the first restricting member 71 is fitted against the second connecting member 82. In the present embodiment, the first restricting member 71 is configured to limit a maximum retracted position of the second footrest member 7 to prevent the second footrest member 7 from loosening when the second footrest member 7 fails to contract to a predetermined position. At the same time, footrest surfaces of both the second footrest member 7 and the first footrest member 5 are in a same vertical plane, which improves the aesthetics of the seat in a retracted state.

Specifically, an end of the second link 2 proximal to the first link 1 is provided with a first connecting point 21, the second link 2 is hinged to a middle of the third link 3 at the first connecting point 21, and the third link 3 is used to connect with the linkage support 10. The second link 2 is cross-connected to the third link 3.

Specifically, an end of the second link 2 proximal to the first footrest member 5 is provided with a second connecting point 22, and the second link 2 is hinged to the second connecting member 82 at the second connecting point 22. In the present embodiment, the first connecting member 81 and the second connecting member 82 are configured to be connected and supported to the second footrest member 7. The second footrest member 7, the first connecting member 81, the second connecting member 82, and the fourth link 4 constitute a four-link mechanism that is capable of being folded and unfolded, so as to support and drive the second footrest member 7 to stretch.

Specifically, an end of the fourth link 4 proximal to the second footrest member 7 is provided with a footrest connecting point 41, a driven-rod connecting point 42, and a connecting-member connecting point 43 in sequence; and the fourth link 4 is connected to the second footrest member 7 at the footrest connecting point 41, the fourth link 4 is connected to the driven rod 6 at the driven-rod connecting point 42, and the fourth link 4 is connected to the second connecting member 82 at the connecting-member connecting point 43, in which the driven-rod connecting point 42 is provided between the footrest connecting point 41 and the connecting-member connecting point 43.

Specifically, the first footrest member 5 is provided with a second-link connecting point 51 and a linkage point 52, and a distance between the linkage point 52 and the driven-rod connecting point 42 is greater than a distance between the linkage point 52 and the second-link connecting point 51. Specifically, a distance between the linkage point 52 and the second-link connecting point 51 is less than a distance between the linkage point 52 and the driven-rod connecting point 42. In such a setup, when the first footrest member 5 is extended, the second link 2 drives the second-link connecting point 51 to move downwards relative to the linkage point 52, so that the footrest surface of a first footrest member 5 smoothly rotates to a horizontal position where a footrest surface faces upwards, thereby enabling the first footrest member 5 to be unfolded more flexibly and quickly.

Specifically, in the present embodiment, the connection among the first link 1, the second link 2, the third link 3, the fourth link 4, the first footrest member 5, the driven rod 6, the second footrest member 7, and the footrest connecting member 8 is a pivotable connection or a hinge connection. The parts may be connected to each other by a combination of pivots, pins, rivets, bolts and nuts, or other fasteners that allow for a pivotable connection.

Preferably, in the present embodiment, the first footrest member 5 is positioned above the second footrest member 7 when the footrest extension mechanism is retracted to a limit position, and footrest surfaces of both the first footrest member 5 and the second footrest member 7 are in a same vertical plane. Footrest surfaces of both the first footrest member 5 and the second footrest member 7 are rotated upwards when the footrest extension mechanism is extended from a retracted position to a limit position, and the first footrest member 5 and the second footrest member 7 are spaced apart from each other.

Specifically, as shown in FIG. 1, the footrest extension mechanism further includes a footrest plate assembly 9, the footrest plate assembly 9 including a first footrest plate 91 and a second footrest plate 92, in which the first footrest plate 91 is connected to the first footrest member 5, and the second footrest plate 92 is connected to the second footrest member 7. Specifically, the first footrest member 5 and the second footrest member 7 are respectively provided with a footrest surface bent inward, and the footrest surface is fixedly connected to the footrest plate, that is, the first footrest plate 91 and the second footrest plate 92 are respectively fixed on the footrest surface corresponding thereto.

Figure 2:
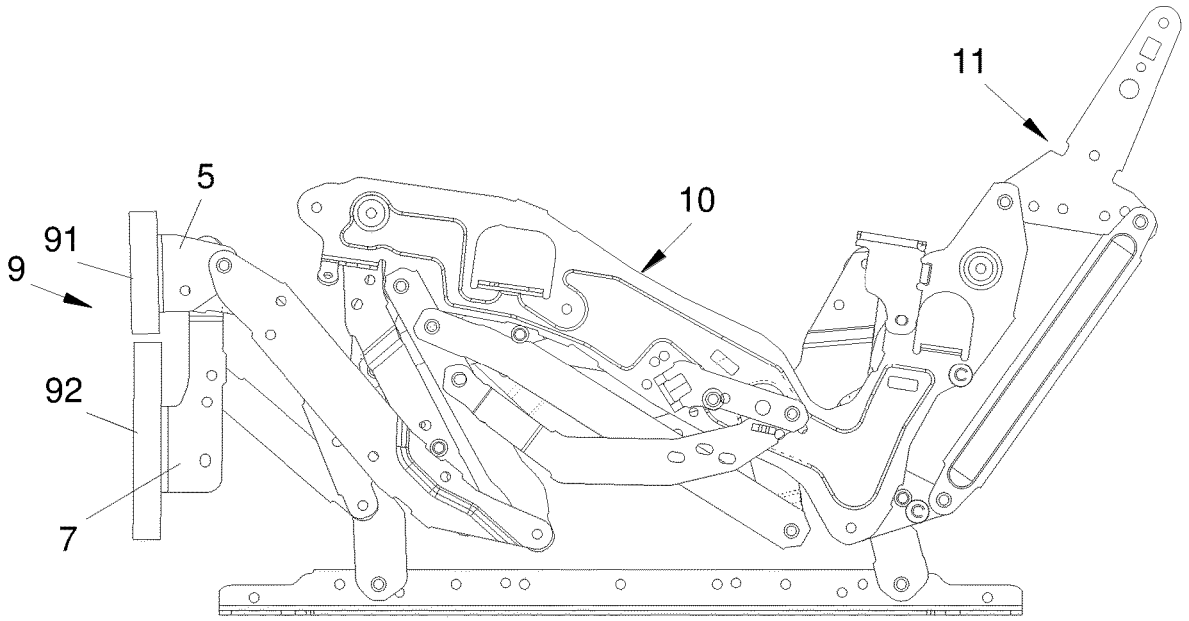
FIG. 2 is a structural diagram in a sitting position state of a seat extending and retracting device of the embodiment of the present disclosure.
Figure 3:
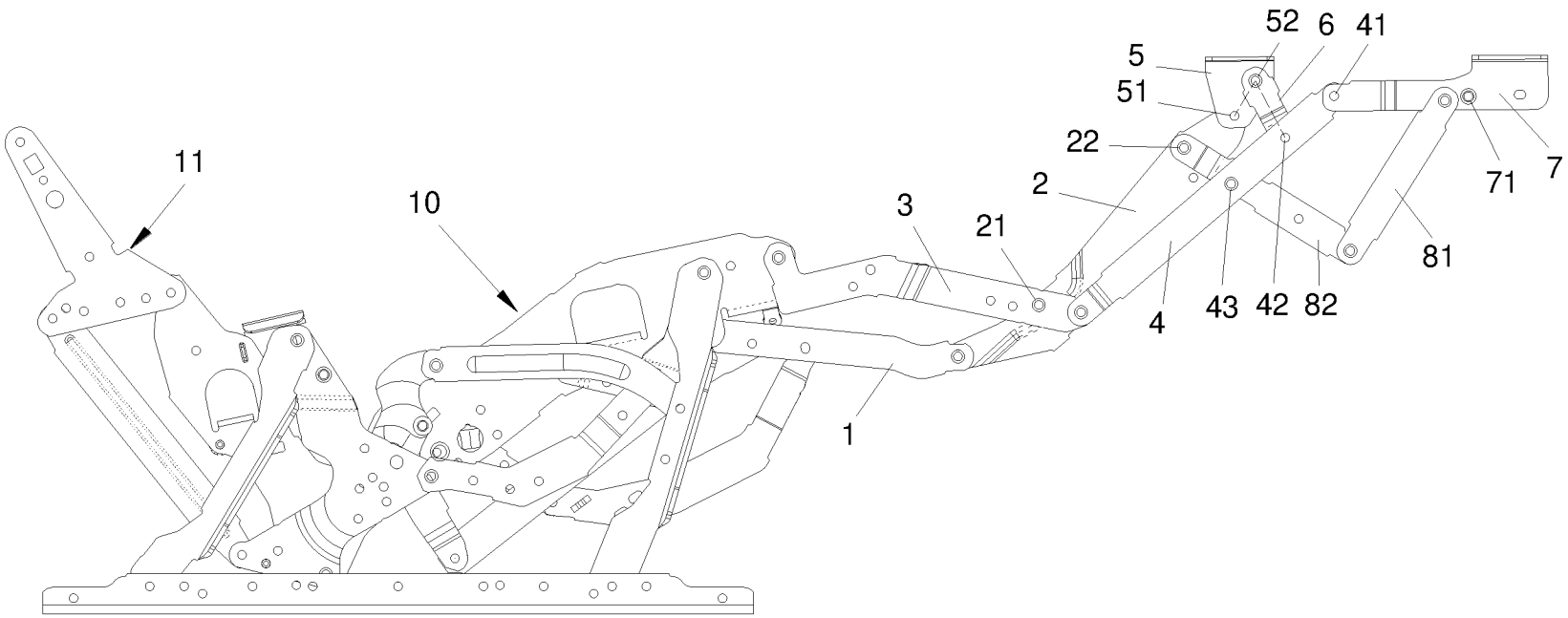
FIG. 3 is a structural diagram in a lying position state of a seat extending and retracting device of the embodiment of the present disclosure.
Figure 4:
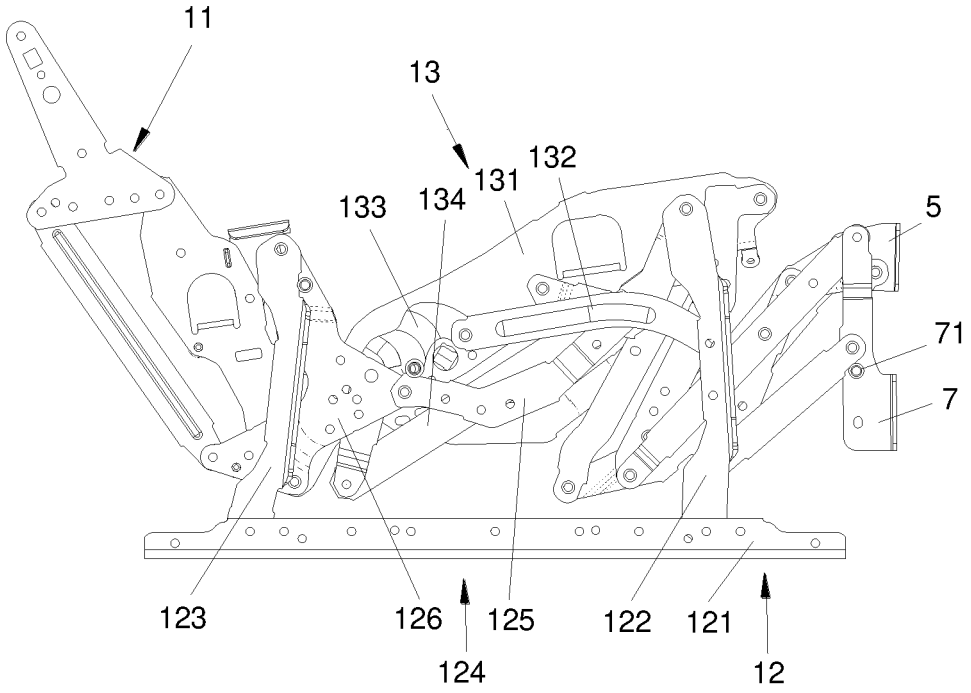
FIG. 4 is a structural diagram of another surface of FIG. 2.
Figure 5:
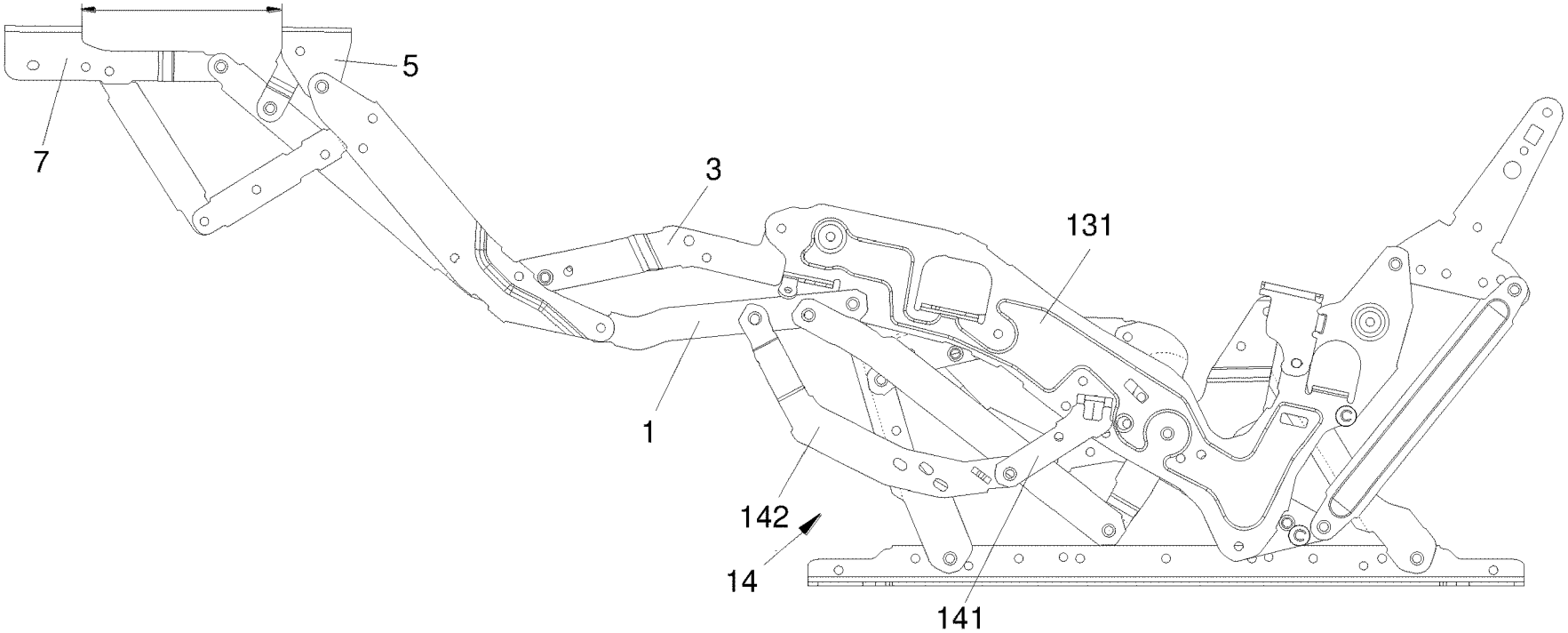
FIG. 5 is a structural diagram of another surface of FIG. 3.

In the present embodiment, as shown in FIGS. 2-3, the linkage support 10 of the seat drives the first link 1 and the third link 3 to rotate, so that the footrest extension mechanism moves from a retracted position shown in FIG. 2 to an extended position shown in FIG. 3. In the extended position, footrest surfaces of both the first footrest member 5 and the second footrest member 7 are in a horizontal position. When the footrest extension mechanism moves from the retracted position to the limit position, the second link 2 drives the first footrest member 5 to rotate upwards. The driven rod 6 is rotated along with the first footrest member 5 to enable the first footrest member 5 to rotate more flexibly while supporting the first footrest member 5. The fourth link 4 drives the second footrest member 7 and the footrest connecting member 8 to extend forwards and rotate upwards until the second footrest member 7 extends to the limit position. When the footrest extension mechanism is retracted from the extended position to the limit position, the movement direction of the components in the footrest extension mechanism is opposite to that of the extension process.

In some embodiments, when the footrest extension mechanism extends to the limit position, a distance between the first footrest member 5 and the second footrest member 7 is greater than 140 mm, and preferably, may be 145 mm, 147 mm, 150 mm or 155 mm, increasing the spacing distance after the first footrest member 5 and the second footrest member 7 are extended.

The first footrest member 5 of the footrest extension mechanism of the present disclosure is hinged to the fourth link 4 by means of the driven rod 6, so that the first footrest member 5 and the second footrest member 7 may be brought together and separated more flexibly. When retracted, the two footrest members are retracted to be brought together, which occupies a small amount of space. When extended, the extending length of the footrest extension mechanism is increased, legs and feet are better supported, the comfort of the seat is improved, and the operating requirements of users with different heights are met.

The present embodiment is further provided with a seat extending and retracting device, as shown in FIGS. 2-5, including a footrest extension mechanism, a linkage support 10, and a back mechanism 11, in which an end of the linkage support 10 is connected to the back mechanism 11, an opposite end of the linkage support 10 is connected to the footrest extension mechanism, and the footrest extension mechanism is connected to the footrest plate assembly 9.

Specifically, the linkage support 10 includes a support structure 12 and a linkage structure 13. The support structure 12 includes a base 121, a first supporting member 122, a second supporting member 123, and a base driven assembly 124. An end of the base 121 is connected to the first supporting member 122, an opposite end of the base 121 is connected to the second supporting member 123, and the base driven assembly 124 is provided between the first supporting member 122 and the second supporting member 123. Specifically, the base driven assembly 124 includes a seat driven member 125 and a back driven member 126. An end of the seat driven member 125 is connected to the first supporting member 122, and an opposite end of the seat driven member 125 is connected to the back driven member 126.

Specifically, the linkage structure 13 includes a lateral plate 131, a first linkage member 132, a second linkage member 133, and a third linkage member 134, a middle of the second linkage member 133 is rotatably connected to the lateral plate 131, an end of the second linkage member 133 is connected to an end of the first linkage member 132, an opposite end of the first linkage member 132 is connected to the first supporting member 122, an opposite end of the second linkage member 133 is connected to an end of the third linkage member 134, and an opposite end of the third linkage member 134 is connected to the footrest extension mechanism.

Specifically, the linkage support 10 further includes a transmission structure 14, in which the transmission structure 14 includes a first transmission member 141 and a second transmission member 142 that are connected to each other. The first transmission member 141 is configured to be connected to a driving apparatus, the second transmission member 142 is connected to the footrest extension mechanism, and the driving apparatus is configured to drive the linkage support 10 to move through the transmission structure 14. In some embodiments, the driving device may be a manual driving device. In other embodiments, the driving device may be an electric driving device, and the electric driving device may be a push rod motor or a slider motor driving device.

Specifically, in the present embodiment, the back mechanism 11 is connected to the lateral plate 131 of the linkage structure 13, and the linkage support 10 moves to drive the back mechanism 11 and the footrest extension mechanism to extend or retract.

In the present embodiment, the footrest extension mechanism and the back mechanism 11 may be continuously adjusted; when only the footrest extension mechanism is extended, the corresponding seat is in a relaxing position; when both the footrest extension mechanism and the back mechanism 11 are extended to a limit position, the corresponding seat is in a lying position; and when the footrest extension mechanism and the back mechanism 11 are retracted to a limit position, the corresponding seat is in a sitting position.

The present embodiment relates to a footrest extension mechanism and a seat extending and retracting device. By adjusting the structure of the footrest extension mechanism, the extending and retracting of the footrest extension mechanism is more flexible, the extending length of the footrest extension mechanism is increased, legs and feet are better supported, the comfort of the seat is improved, and the utilization requirements of users with different heights are met.

In the present embodiment, there are two sets of the seat extending and retracting devices. The two sets of the extending and retracting devices are spaced and symmetrically arranged on the basis of a central plane of the base 121. A seat frame is provided on the seat extending and retracting device, and the seat extending and retracting device is upholstered as a finished sofa.

In view of the technical solutions mentioned above, the present disclosure has beneficial effects as follows.

The first footrest member of the footrest extension mechanism of the present disclosure is hinged to the fourth link by means of the driven rod, so that the first footrest member and the second footrest member may be brought together and separated more flexibly. When retracted, the two footrest members are retracted to be brought together, which occupies a small amount of space. When extended, the extending length of the footrest extension mechanism is increased, the legs and the feet are better supported, the comfort of the seat is improved, and the utilization requirements of users with different heights are met.

The description mentioned above has fully disclosed the detailed description of the embodiments of the present disclosure. It should be noted that any changes made by those skilled in the art to the detailed description of the embodiments of the present disclosure do not depart from the scope of the claims of the present disclosure. Accordingly, the scope of the claims of the present disclosure is not only limited to the embodiments mentioned above.

The invention claimed is:

1. A footrest extension mechanism, comprising a first link, a second link, a third link, a fourth link, a first footrest member, a driven rod, a second footrest member, and a footrest connecting member;

an end of the second link is hinged to the first footrest member, and an opposite end of the second link is hinged to the first link, wherein the first link is used to be hinged to a linkage support of a seat; an end of the fourth link is hinged to the second footrest member, an opposite end of the fourth link is hinged to the third link, an end of the driven rod is hinged to the first footrest member, and an opposite end of the driven rod is hinged to a middle of the fourth link; and the footrest connecting member comprises a first connecting member and a second connecting member, wherein an end of the first connecting member is hinged to a middle of the second footrest member, an opposite end of the first connecting member is hinged to an end of the second connecting member, an opposite end of the second connecting member is hinged to a middle of the second link, and the middle of the second connecting member is hinged to a middle of the fourth link.

2. The footrest extension mechanism according to claim 1, wherein a middle of the second footrest member is provided with a first restricting member, and the second footrest member is retracted to a limit position to prevent the second footrest member from loosening when the first restricting member is fitted against the second connecting member.

3. The footrest extension mechanism according to claim 1, wherein an end of the second link proximal to the first link is provided with a first connecting point, the second link is hinged to a middle of the third link at the first connecting point, and the third link is used to connect with the linkage support.

4. The footrest extension mechanism according to claim 1, wherein an end of the second link proximal to the first footrest member is provided with a second connecting point, and the second link is hinged to the second connecting member at the second connecting point.

5. The footrest extension mechanism according to claim 1, wherein an end of the fourth link proximal to the second footrest member is provided with a footrest connecting point, a driven-rod connecting point, and a connecting-member connecting point in sequence; and the fourth link is connected to the second footrest member at the footrest connecting point, the fourth link is connected to the driven rod at the driven-rod connecting point, and the fourth link is connected to the second connecting member at the connecting-member connecting point, wherein the driven-rod connecting point is provided between the footrest connecting point and the connecting-member connecting point.

6. The footrest extension mechanism according to claim 5, wherein the first footrest member is provided with a second-link connecting point and a linkage point, and a distance between the linkage point and the driven-rod connecting point is greater than a distance between the linkage point and the second-link connecting point.

7. The footrest extension mechanism according to claim 1, wherein the first footrest member is positioned above the second footrest member when the footrest extension mechanism is retracted to a limit position, and footrest surfaces of both the first footrest member and the second footrest member are in a same vertical plane.

8. The footrest extension mechanism according to claim 1, wherein footrest surfaces of both the first footrest member and the second footrest member are rotated upwards when the footrest extension mechanism is extended from a retracted position to a limit position, and the first footrest member and the second footrest member are spaced apart from each other.

9. The footrest extension mechanism according to claim 1, further comprising a footrest plate assembly, the footrest plate assembly comprising a first footrest plate and a second footrest plate, wherein the first footrest plate is connected to the first footrest member, and the second footrest plate is connected to the second footrest member.

10. A seat extending and retracting device, comprising a footrest extension mechanism, a linkage support, and a back mechanism, wherein an end of the linkage support is connected to the back mechanism, an opposite end of the linkage support is connected to the footrest extension mechanism, and the footrest extension mechanism is connected to a footrest plate assembly;

the footrest extension mechanism comprises a first link, a second link, a third link, a fourth link, a first footrest member, a driven rod, a second footrest member, and a footrest connecting member;

an end of the second link is hinged to the first footrest member, and an opposite end of the second link is hinged to the first link, wherein the first link is used to be hinged to a linkage support of a seat; an end of the fourth link is hinged to the second footrest member, an opposite end of the fourth link is hinged to the third link, an end of the driven rod is hinged to the first footrest member, and an opposite end of the driven rod is hinged to a middle of the fourth link; and the footrest connecting member comprises a first connecting member and a second connecting member, wherein an end of the first connecting member is hinged to a middle of the second footrest member, an opposite end of the first connecting member is hinged to an end of the second connecting member, an opposite end of the second connecting member is hinged to a middle of the second link, and the middle of the second connecting member is hinged to a middle of the fourth link.

11. The seat extending and retracting device according to claim 10, wherein a middle of the second footrest member is provided with a first restricting member, and the second footrest member is retracted to a limit position to prevent the second footrest member from loosening when the first restricting member is fitted against the second connecting member.

12. The seat extending and retracting device according to claim 10, wherein an end of the second link proximal to the first link is provided with a first connecting point, the second link is hinged to a middle of the third link at the first connecting point, and the third link is used to connect with the linkage support.

13. The seat extending and retracting device according to claim 10, wherein an end of the second link proximal to the first footrest member is provided with a second connecting point, and the second link is hinged to the second connecting member at the second connecting point.

14. The seat extending and retracting device according to claim 10, wherein an end of the fourth link proximal to the second footrest member is provided with a footrest connecting point, a driven-rod connecting point, and a connecting-member connecting point in sequence; and the fourth link is connected to the second footrest member at the footrest connecting point, the fourth link is connected to the driven rod at the driven-rod connecting point, and the fourth link is connected to the second connecting member at the connecting-member connecting point, wherein the driven-rod connecting point is provided between the footrest connecting point and the connecting-member connecting point.

15. The seat extending and retracting device according to claim 14, wherein the first footrest member is provided with a second-link connecting point and a linkage point, and a distance between the linkage point and the driven-rod connecting point is greater than a distance between the linkage point and the second-link connecting point.

16. The seat extending and retracting device according to claim 10, wherein the first footrest member is positioned above the second footrest member when the footrest extension mechanism is retracted to a limit position, and footrest surfaces of both the first footrest member and the second footrest member are in a same vertical plane.

17. The seat extending and retracting device according to claim 10, wherein footrest surfaces of both the first footrest member and the second footrest member are rotated upwards when the footrest extension mechanism is extended from a retracted position to a limit position, and the first footrest member and the second footrest member are spaced apart from each other.

18. The seat extending and retracting device according to claim 10, further comprising a footrest plate assembly, the footrest plate assembly comprising a first footrest plate and a second footrest plate, wherein the first footrest plate is connected to the first footrest member, and the second footrest plate is connected to the second footrest member.

* * * * *